US007573435B2

(12) United States Patent
Lee et al.

(10) Patent No.: US 7,573,435 B2
(45) Date of Patent: Aug. 11, 2009

(54) CONVEX MOUNT FOR ELEMENT REDUCTION IN PHASED ARRAYS WITH RESTRICTED SCAN

(75) Inventors: Gregory S Lee, Mountain View, CA (US); Richard Paul Tella, Sunnyvale, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 88 days.

(21) Appl. No.: 11/552,193

(22) Filed: Oct. 24, 2006

(65) Prior Publication Data

US 2008/0094301 A1 Apr. 24, 2008

(51) Int. Cl.
*H01Q 21/00* (2006.01)

(52) U.S. Cl. ..... 343/853; 343/844

(58) Field of Classification Search ..... 343/844, 343/853, 909
See application file for complete search history.

(56) References Cited

U.S. PATENT DOCUMENTS

| | | | | |
|---|---|---|---|---|
| 3,757,333 | A * | 9/1973 | Procopio | 342/372 |
| 5,128,687 | A * | 7/1992 | Fay | 343/754 |
| 5,241,323 | A * | 8/1993 | Kelly | 343/754 |
| 6,225,946 | B1 * | 5/2001 | Kreutel et al. | 342/368 |
| 6,690,333 | B2 * | 2/2004 | Eiges | 343/757 |
| 6,961,025 | B1 * | 11/2005 | Chethik et al. | 343/786 |
| 2008/0094300 | A1 * | 4/2008 | Lee | 343/844 |

* cited by examiner

*Primary Examiner*—Tan Ho

(57) ABSTRACT

Grating lobe free scanning in a phased array with sparse element spacing is obtained by restricting the maximum scan angle for elements in the array, and arranging the elements in a convex form. One convex form is a paraboloid, which may be continuous, or piecewise in nature, tiled with flat segments.

15 Claims, 3 Drawing Sheets

CONVEX MOUNT FOR ELEMENT REDUCTION IN PHASED ARRAYS WITH RESTRICTED SCAN

CROSS-REFERENCE TO RELATED APPLICATIONS

This application is related by subject matter to U.S. application for patent Ser. No. 10/997,422, entitled "A Device for Reflecting Electromagnetic Radiation," U.S. application for patent Ser. No. 10/997,583, entitled "Broadband Binary Phased Antenna," both of which were filed on Nov. 24, 2004, and U.S. Pat. No. 6,965,340, entitled "System and Method for Security Inspection Using Microwave Imaging," which issued on Nov. 15, 2005.

This application is further related by subject matter to U.S. application for patent Ser. No. 11/088,536, entitled "System and Method for Efficient, High-Resolution Microwave Imaging Using Complementary Transmit and Receive Beam Patterns," U.S. application for patent Ser. No. 11/088,831, entitled "System and Method for Inspecting Transportable Items Using Microwave Imaging," U.S. application for patent Ser. No. 11/089,298, entitled "System and Method for Pattern Design in Microwave Programmable Arrays," U.S. application for patent Ser. No. 11/088,610, entitled "System and Method for Microwave Imaging Using an Interleaved Pattern in a Programmable Reflector Array," and U.S. application for patent Ser. No. 11/088,830, entitled "System and Method for Minimizing Background Noise in a Microwave Image Using a Programmable Reflector Array" all of which were filed on Mar. 24, 2005.

This application is further related by subject matter to U.S. application for patent Ser. No. 11/181,111, entitled "System and Method for Microwave Imaging with Suppressed Sidelobes Using Sparse Antenna Array," which was filed on Jul. 14, 2005, U.S. application for patent Ser. No. 11/147,899, entitled "System and Method for Microwave Imaging Using Programmable Transmission Array," which was filed on Jun. 8, 2005 and U.S. application for patent Ser. No. 11/303,581, entitled "Handheld Microwave Imaging Device" and Ser. No. 11/303,294, entitled "System and Method for Standoff Microwave Imaging," both of which were filed on Dec. 16, 2005.

TECHNICAL FIELD

Embodiments in accordance with the present invention relate to phased arrays, and in particular to sparse phased arrays.

BACKGROUND

Phased arrays, in ultrasonic applications and from the RF to the visible end of the electromagnetic spectrum, provide beam steering with no moving parts. Electronic control replaces mechanical control, which is a tremendous advantage in terms of speed and maintenance. Unfortunately, these advantages are often offset by a cost disadvantage. The number of electronic elements in a circular array is on the order of $\pi(D/\lambda)^2$, where D is the diameter of the circular array and $\lambda$ is the operating wavelength. This comes about as the standard rule is to space antenna elements apart by $\lambda/2$ in both directions to suppress sidelobes throughout a hemispherical scan.

In most traditional phased arrays, the control devices are expensive, and in some cases each may require one or more stages of amplification. Even when the active devices are relatively inexpensive, the overall phased array system may require a very deep digital memory to support a large set of focal areas or volumes.

In order to bring the cost down, it is attractive to reduce the number of antenna elements making up the array, thereby reducing the number of control devices, as well as the width of the supporting driver memory.

Simply omitting elements from an originally dense phased array produces a so-called sparse array. Sparse arrays are well known in the ultrasound and microwave/millimeter wave literature to create new problems, particularly the appearance of so-called grating sidelobes. That is, in addition to the desired main scanning lobe, there are additional high-level lobes created at different angles. These sidelobes contribute ghosting phenomena to the scanning or imaging process.

Various post-processing remedies have been tried. For example, deconvolution algorithms can be applied, but the most successful of these are nonlinear algorithms which are both scene dependent and very time consuming. Two of the most popular deconvolution algorithms are CLEAN (ref) and the Maximal Entropy Method, or MEM (ref). An older, linear (and hence faster and more general) approach is Wiener-Helstrom filtering (ref), but it is well known that it produces inferior image reconstruction compared to the nonlinear approaches (which are slower and more specialized) such as Maximum Likelihood (ML) iteration (ref). Correlation imaging, involving different subsets of an already sparse array, is also a nonlinear scheme which tends to be quite slow, i.e., not suitable for real-time use. In some cases, such as radioastronomy, one has a priori knowledge of the scene (say, from visible telescopes) which can be used to weed out much of the ghost phenomena Obviously, this "solution" is inadequate in dealing with a highly dynamic environment.

What is needed is a satisfactory real-time, scene-independent solution to the ghosting problem of reduced element (sparse) arrays.

SUMMARY OF THE INVENTION

Sidelobe-free scanning in a phased array with element spacing greater than $\lambda/2$ is accomplished by restricting maximum scan angles to less than $\pi/2$ radians and forming the array into a convex form which may approach either a cylindrical, spherical, ellipsoidal, or paraboloid form in two or three dimensions.

DETAILED DESCRIPTION OF THE EMBODIMENTS

In phased-array systems, the commonly stated requirement for $\lambda/2$ spacing between elements (where $\lambda$ is the operating wavelength) arises from the desire to minimize sidelobes when scanning at angles up to $\pi/2$ radians, or 90° from the scan center, which is a line normal to the plane of the array. Sparse arrays, where the element spacing is greater than $\lambda/2$ create grating sidelobes for large scan angles. While post-processing approaches to reduce the ghosting introduced by these sidelobes exist the better ones are computationally expensive and scene dependent, making them impractical in dynamic environments such as security scanning.

In prototypical phased array applications such as the Distant Early Warning (DEW) radar system, or AEGIS AN/SPY-1 phased array radars, wide scan angles, up to 2 π steraians, are required. However, in many applications, a smaller solid angle scan field is sufficient. As an example, in security screening of individuals or objects, the scan solid angle is limited by body size or object size, and is far less than 2π steradians. Similarly, a systems designer may wish to have N phased arrays opening in parallel in order to increase throughput by a factor of N, i.e. looking at N bodies or targets in a given volume at the same time. In such a case the solid scan angle required of any given array in the system is roughly divided by N.

Figure 1:
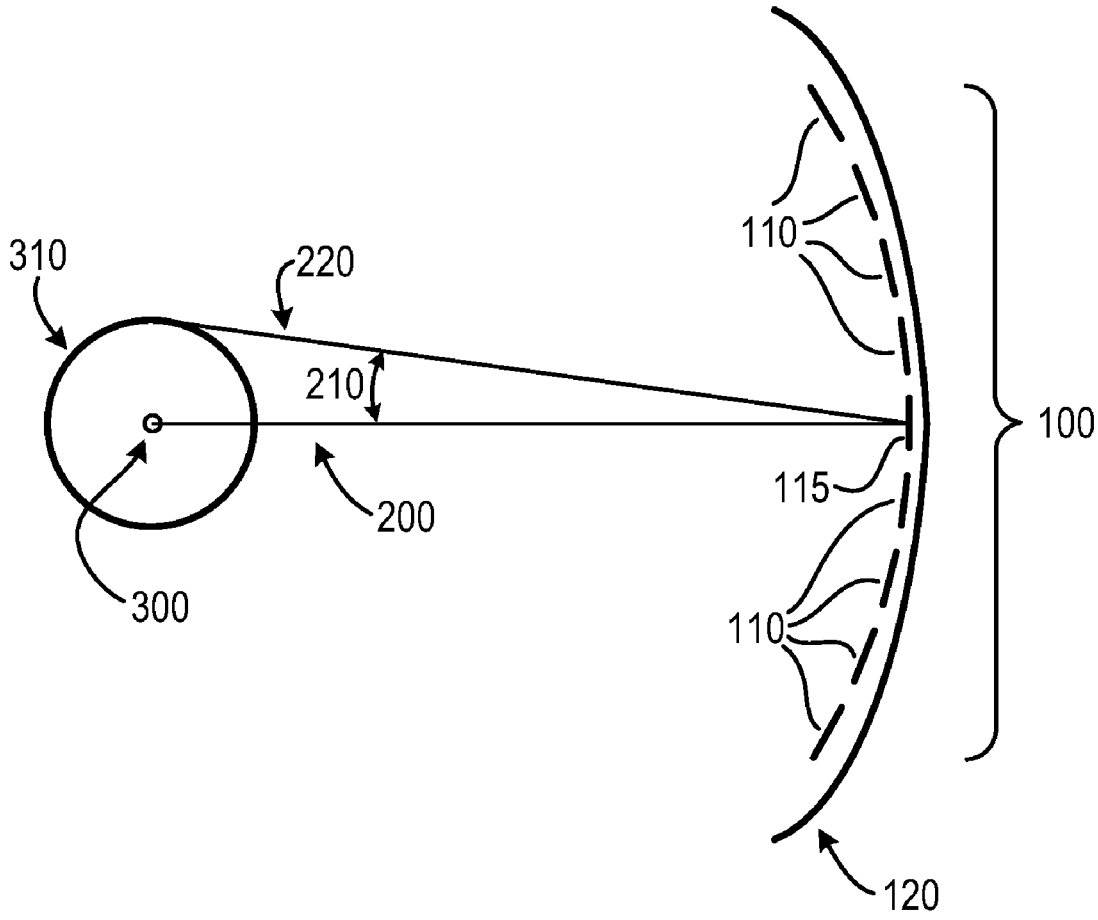
FIG. 1 shows a first system diagram.

A top view of an embodiment of the present invention is shown in FIG. 1. Array tiles 110 form phased array 100. Tiles 110 are arranged to approximate a paraboloid 120. For each tile 110, the scan center line, shown as 200, is defined as the line normal to the plane of the tile and intersecting the tile at its center. The maximum scan angle $\theta_{max}$ 210 when extended as line 220 generates scan zone boundary 310 with the center of the scan zone 300 being the parabolic focus. According to the present invention the maximum scan angle $\theta_{max}$ is considerably less than π/2 radians, or 90° from the scan center of each tile.

Each tile 110 is comprised of a plurality of elements, commonly packaged together with their control system. In a dense array, these elements are optimally spaced at λ/2, commonly in a rectangular or hexagonal packing. According to the present invention, since the maximum scan angle $\theta_{max}$ 210 is now restricted, element packing may be less dense while still insuring grating lobe free scanning For a continuous-phase phased array, the maximum element period p (spacing) free of grating lobes is $p=\lambda/(1+\sin(\theta_{max}))^2$. It can be seen that this relationship encompasses the common limiting cases. For $\theta_{max}=\pi/2$, $p=\lambda/2$, and for $p=\lambda$, $\theta_{max}=0$. For a 2D array, the element density is reduced by a factor of $4/(1+\sin(\theta_{max}))^2$.

Figure 2:
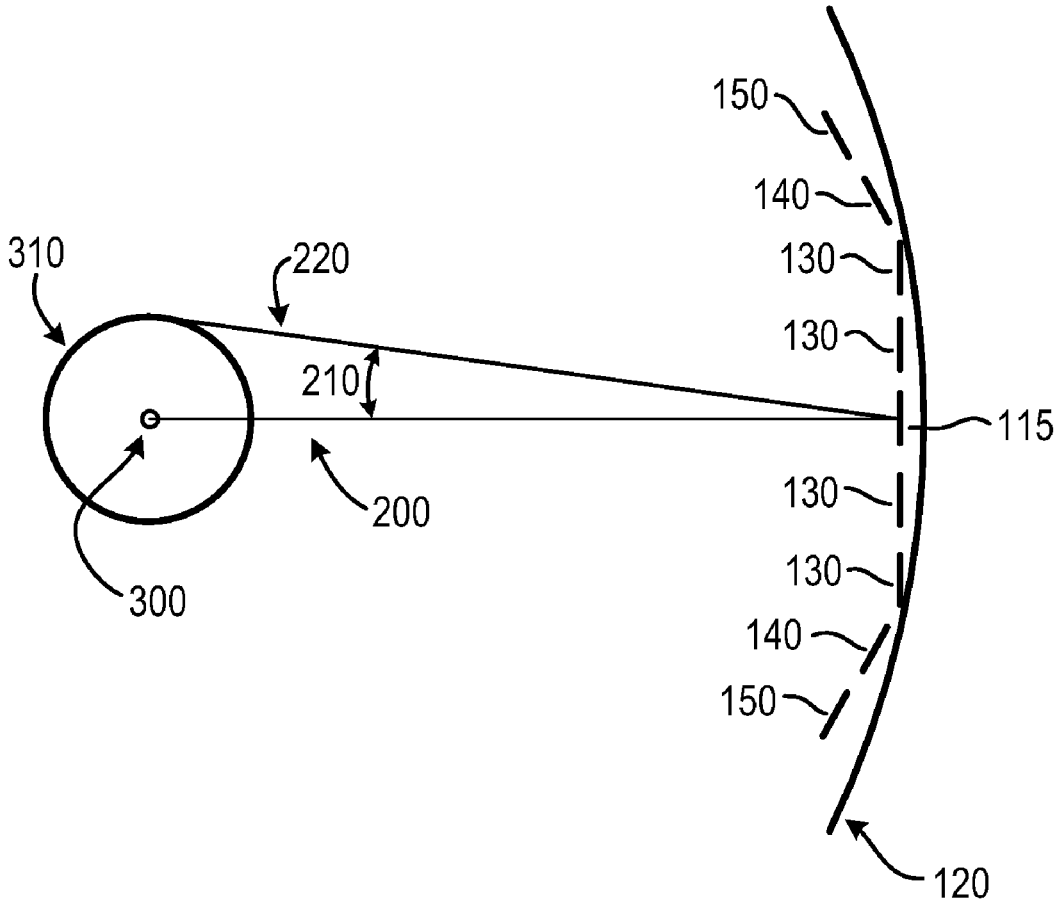
FIG. 2 and FIG. 3 show second and third system diagrams, respectively.

The parabolic form shown in FIG. 1 represents one embodiment. The arrangement of tiles 110 must be convex, and may be piecewise-planar, consisting of flat tile segments approximating a parabola 120, as shown in FIG. 1, or other convex form as shown in FIG. 2. Examples of other useful convex forms are a circle and an ellipse. The curved form 120 may be designed to approximate any of the classic conic sections with the exception of a hyperbola; the choice of conic section for form 120 depends on how the array is fed.

In FIG. 2, a set of coplanar tiles 110 and 130 are surrounded by tiles 140 and 150 which are angled in, forming a convex surface which is symmetrical around its center point in his case, tile 115. An alternative embodiment would be a true non-segmented paraboloid or ellipsoid, with the entire array of elements formed onto a curved surface.

Figure 3:
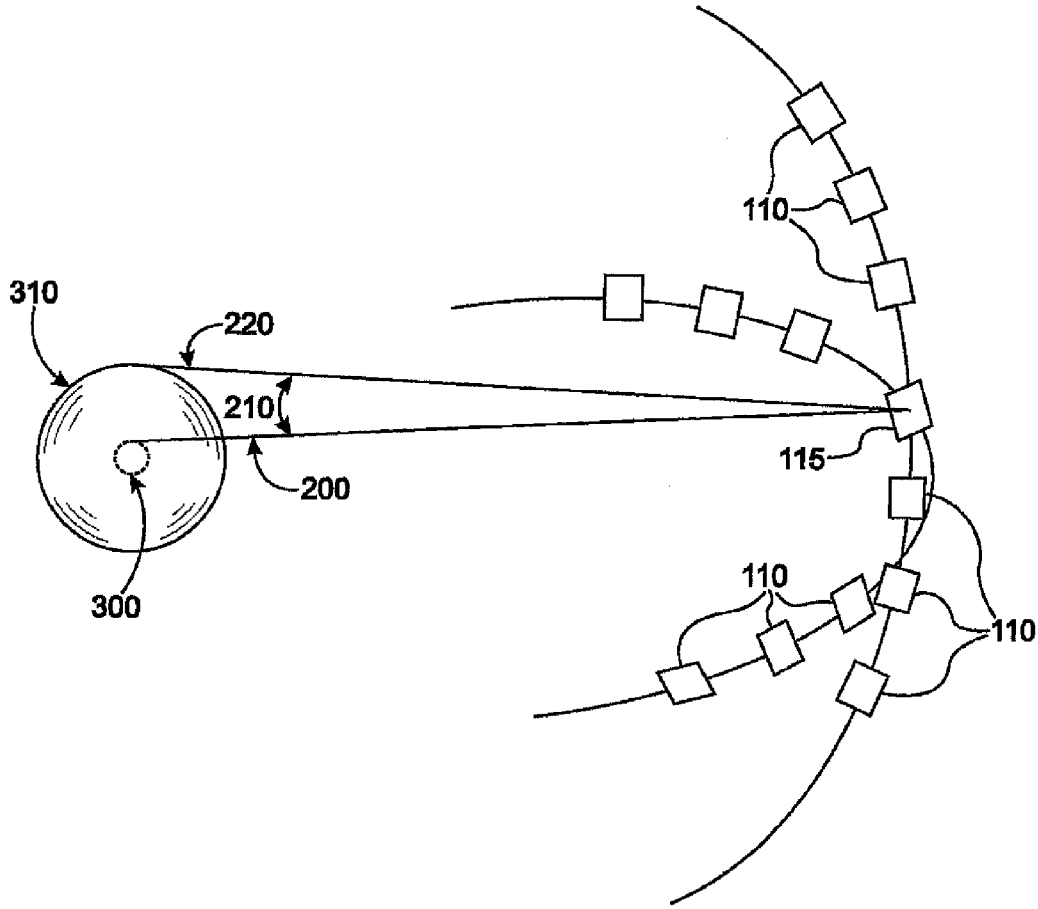

In an embodiment used for scanning people, the volume to be scanned may be thought of as cylindrical in nature, and antenna array 100 need form a convex shape such as a parabola 120 in two dimensions. In a system where the target volume is spherical in nature, antenna array 100 should form a convex shape in three dimensions, as shown in FIG. 3, for example. This shape can be a sphere, a cylinder, an ellipsoid, a paraboloid, or a piecewise-planar approximation of any of these.

The principles of the present invention pertain equally to not only continuous-phase transmit or receive arrays, but also to other modalities such as reflectarrays, transmission (lens) arrays, binary-phase arrays, and so on. As an example, in a reflectarray geometry, the convex shape is chosen to focus the feedhorn to the sweet spot of the pattern i.e. the feedhorn and the scan center are conjugate foci. An ellipsoid is the preferred shape in this case.

In another example, the array is one of a passive programmable reflector array.

While the embodiments of the present invention have been illustrated in detail, it should be apparent that modifications and adaptations to these embodiments may occur to one skilled in the art without departing from the scope of the present invention as set forth in the following claims.

The invention claimed is:

1. A phase array antenna operating at a wavelength λ comprising a plurality of antenna elements arranged into an array, wherein the antenna elements are:

arranged along a curvature of one of a parabola, an ellipse and a circle to focus at a focal point of the curvature; and spaced greater than λ/2 from each other; wherein the focal point defines a scan zone.

2. The phased array antenna of claim 1 where the array operates with a maximum scan angle of less than π/2 radians.

3. The phased array antenna of claim 2 where the array elements are arranged to be piecewise-convex.

4. The phased array antenna of claim 1 where the array is an active array.

5. The phased array antenna of claim 1 where the array is a passive array.

6. The phased array antenna of claim 1 where the array is a transmissive array.

7. The phased array antenna of claim 1 where the array is a reflector array.

8. The phased array antenna of claim 1 where the away is a passive programmable reflector array.

9. A phase array antenna operating at a wavelength λ comprising:

a plurality of antenna elements arranged into an array, where the antenna elements are arranged to be convex in three dimensions, and spaced greater than λ/2 in the convex direction.

10. The phased away antenna of claim 9, wherein the away has a maximum scan angle of less than π/2 radians.

11. The phased away antenna of claim 10, wherein the away elements are piecewise-convex in at least one convex direction.

12. The phased away antenna of claim 9, where the convexity in each direction approaches one of a parabola, an ellipse and a circle.

13. The phased away antenna of claim 9, wherein the away comprises an active array.

14. The phased away antenna of claim 9, wherein the away comprises a passive array.

15. The phased away antenna of claim 9, wherein the away comprises one of a transmissive array and a reflector array.

* * * * *

UNITED STATES PATENT AND TRADEMARK OFFICE

CERTIFICATE OF CORRECTION

PATENT NO. : 7,573,435 B2
APPLICATION NO. : 11/552193
DATED : August 11, 2009
INVENTOR(S) : Gregory S Lee et al.

It is certified that error appears in the above-identified patent and that said Letters Patent is hereby corrected as shown below:

In column 4, line 37, in Claim 8, delete “away” and insert -- array --, therefor.

In column 4, line 39, in Claim 9, delete “λ” and insert -- λ, --, therefor.

In column 4, line 41, in Claim 9, delete “into” and insert -- in --, therefor.

In column 4, line 43, in Claim 9, delete “the” and insert -- each --, therefor.

In column 4, line 45, in Claim 10, delete “phased away” and insert -- phased array --, therefor.

In column 4, line 45, in Claim 10, delete “the away” and insert -- the array --, therefor.

In column 4, line 47, in Claim 11, delete “away” and insert -- array --, therefor.

In column 4, line 48, in Claim 11, delete “away” and insert -- array --, therefor.

In column 4, line 50, in Claim 12, delete “away” and insert -- array --, therefor.

In column 4, line 50, in Claim 12, delete “where” and insert -- wherein --, therefor.

In column 4, line 54, in Claim 13, delete “phased away” and insert -- phased array --, therefor.

In column 4, line 54, in Claim 13, delete “the away” and insert -- the array --, therefor.

In column 4, line 56, in Claim 14, delete “phased away” and insert -- phased array --, therefor.

In column 4, line 56, in Claim 14, delete “the away” and insert -- the array --, therefor.

In column 4, line 58, in Claim 15, delete “phased away” and insert -- phased array --, therefor.

UNITED STATES PATENT AND TRADEMARK OFFICE

CERTIFICATE OF CORRECTION

PATENT NO. : 7,573,435 B2
APPLICATION NO. : 11/552193
DATED : August 11, 2009
INVENTOR(S) : Gregory S Lee et al.

It is certified that error appears in the above-identified patent and that said Letters Patent is hereby corrected as shown below:

In column 4, line 58, in Claim 15, delete "the away" and insert -- the array --, therefor.

Signed and Sealed this

Twenty-ninth Day of September, 2009

David J. Kappos

David J. Kappos
*Director of the United States Patent and Trademark Office*